United States Patent [19]

Yakuwa et al.

[11] Patent Number: 4,964,050

[45] Date of Patent: Oct. 16, 1990

[54] METHOD OF CONTROLLING ELECTRICAL DEVICES OF INTERNAL COMBUSTION ENGINES

[75] Inventors: Masahiko Yakuwa, Wako; Kikuo Tomozawa; Kazuya Kishi, both of Minato, all of Japan

[73] Assignee: Honda Giken Kogyo Kabushiki Kaisha, Tokyo, Japan

[21] Appl. No.: 193,411

[22] Filed: May 12, 1988

[30] Foreign Application Priority Data

Dec. 12, 1987 [JP] Japan ..... 62-115538
Dec. 12, 1987 [JP] Japan ..... 62-115540
Dec. 12, 1987 [JP] Japan ..... 62-115541

[51] Int. Cl.[5] ..... F02D 41/34

[52] U.S. Cl. ..... 364/431.04; 364/431.03; 123/480; 123/487

[58] Field of Search ..... 364/431.04, 431.05, 364/431.03, 431.11; 123/480, 479, 478, 487

[56] References Cited

U.S. PATENT DOCUMENTS 4,145,735 3/1979 Soga ..... 364/200
4,347,570 8/1982 Akiyama et al. ..... 123/417
4,476,532 10/1984 Akiyama et al. ..... 364/431.05
4,581,703 4/1986 Bassi et al. ..... 364/431.05
4,617,899 10/1986 Nakajima ..... 364/431.05
4,766,873 8/1988 Miyagi et al. ..... 123/564

*Primary Examiner*—Parshotam S. Lall
*Assistant Examiner*—V. N. Trans
*Attorney, Agent, or Firm*—Lyon & Lyon

[57] ABSTRACT

A method of controlling a plurality of electrical devices which control an operation of an internal combustion engine wherein an operation period of time required for each of the electrical devices is computed by computing means in response to operating conditions of the engine, the computed required operation period of time is counted by time-counting means, and each of the electrical devices is caused to operate during the counting. At each start of the time-counting from the computing means, a different one of the electrical devices is selected and the operation thereof is started, an interrupt signal is generated when the time-counting means has counted up, and the operation of the selected different one of the electrical devices is deenergized in response to the generation of the interrupt signal. Preferably, the time-counting means comprises a signal time counter.

5 Claims, 13 Drawing Sheets

METHOD OF CONTROLLING ELECTRICAL DEVICES OF INTERNAL COMBUSTION ENGINES

BACKGROUND OF THE INVENTION

This invention relates to a method of controlling electrical devices of an internal combustion engine, and more particularly to a method of controlling energization time periods of the electrical devices which control an operation of an internal combustion engine by the use of an interrupt signal from time-counting means.

Conventionally, in order to control a plurality of electrical devices which control an operation of an internal combustion engine, e.g. fuel injection valves (injectors), a method is known which employs a plurality of time-counting means provided respectively for the electrical devices, for counting energization periods of time thereof, respectively, and each outputting an interrupt signal when the counting of the energization period of time is completed, and a central processing unit for computing the energization periods of time in response to operating conditions of the engine, outputting a counting starting signal for each of the time-counting means when the computing is completed and at the same time outputting an energization starting signal for each of the corresponding electrical devices, and outputting an energization ending signal for each of the electrical devices in response to the interrupt signal from the time-counting means.

However, this known method requires the use of as many time-counting means as the electrical devices, and this brings about the problem of a high manufacturing cost of the electrical device-controlling system.

On the other hand, even if the control of the engergization periods of time of the electrical devices is attempted by the use of a single time-counting means in order to overcome the above disadvantage, it becomes impossible to control the electrical devices properly since there may arise a condition under which two or more electrical devices simultaneously operate (hereinafter referred to as "the overlap condition"). Under the overlap condition the electrical devices must be controlled in such a manner that before the operation of one electrical device is ended, the operation of another electrical device is started.

Further, it is usually designed that the central processing unit carries out not only the computation for the control of the electrical devices but also a number of computations necessary for other kinds of control, and to this end it is provided with a specific time interval during which the control of the electrical devices is not started by an interrupt signal from the time-counting means (hereinafter referred to as "the interrupt-inhibit interval"). Therefore, if an interrupt signal from the time-counting means is produced at a time corresponding to the interrupt-inhibit interval, the interrupt is inhibited until the interrupt-inhibit interval terminates. This interrupt inhibition applies even in the case of a single electrical device. Consequently, the outputting of the energization ending signal for an electrical device is delayed by the time elapsed before the interrupt-inhibit inverval terminates. As a result, the energization period of time of the electrical device is virtually prolonged, which makes it impossible to control the actual energization period of time to a desired value determined in response to operating conditions of the engine, and therefore to secure desired driveability, fuel consumption, etc.

SUMMARY OF THE INVENTION

An object of the invention is, therefore, to provide a method of controlling a plurality of electrical devices of an internal combustion engine, which employs only one time-counting means for counting the energization periods of time for the electrical devices, to thereby enable the reduction of manufacturing cost of the electrical device-controlling system.

A further object of the invention is to provide a method of controlling a plurality of electrical devices of an internal combustion engine, which is capable of properly controlling the energization periods of time for the electrical devices by the use of a single time-counting means even under the overlap condition.

Another object of the invention is to provide a method of controlling electrical devices, which is capable of properly controlling the energization periods of time for the electrical devices even if the central processing unit is provided with the interrupt-inhibit interval, to thereby improve the driveabiltiy, fuel consumption, etc.

In accordance with a first aspect of the present invention, there is provided a method of controlling a plurality of electrical devices which control an operation of an internal combustion engine wherein a required operation period of time for which each of the electrical devices is to be operated is computed by computing means in response to operating conditions of the engine, the computed required operation period of time is counted by time-counting means, and the each of the electrical devices is caused to operate while the time-counting means is operating. The first aspect of the present invention is characterized by comprising the following steps:

(a) outputting an operation starting signal for starting a different one of the electrical devices from the computing means whenever counting by the time-counting means is started;

(b) generating an interrupt signal when the counting by the time-counting means is completed; and (c) outputting an operation ending signal for ending the operation of the different one of the electrical devices from the computing means in response to the generation of the interrupt signal.

Further, in accordance with a second aspect of the present invention, the method further comprises the following steps:

(d) detecting whether another one of the electrical devices is operating, at the time of the outputting of the operation starting signal for the different one of the electrical devices at the step (a);

(e) reading an actual counted value in the time-counting means for the another one of the electrical devices, when the another one of the electrical devices is operating;

(f) determining the remainder of the computed required operation period of time for the another one of the electrical devices from the read actual counted value;

(g) calculating and storing a difference between the computed required operation period of time for the different one of the electrical devices and the determined remainder of the computed operation period of time;

(h) setting the difference into the time-counting means when the interrupt signal is generated from the time-counting means at the step (b);

(i) restarting the time-counting means to count the set difference;

(j) generating an interrupt signal when the counting by the restarted time-counting means is completed; and (k) outputting an operation ending signal for the different one of the electrical devices from the computing means in response to the generation of the interrupt signal at the step (j).

In accordance with a third aspect of the present invention, the method further comprises the following steps:

(d) detecting whether other electrical devices are operating, at the time of the outputting of the operation starting signal for the different one of the electrical devices at the step (a);

(e) determining the number n of the other electrical devices which are operating, when the other electrical devices are operating;

(f) reading an actual counted value in the time-counting means for an electrical device the operation of which was started earliest of the other electrical devices which are operating;

(g) determining the remainder of the computed required operation period of time for the earliest started electrical device from the read actual counted value;

(h) calculating and storing a difference obtained by subtracting from the computed required operation period of time for the different one of the electrical devices the determined remainder of the computed required operation period of time, and a counting value or counting values for the rest of the other electrical devices which are operating;

(i) setting the difference into the time-counting means when interrupt signals from the time-counting means have been produced n times;

(j) restarting the time-counting means to count the set difference;

(k) generating an interrput signal when the counting by the restarted time-counting means is completed; and (l) outputting an operation ending signal for the different one of the electrical devices, from the computing means in response to the generation of the interrupt signal at the step (k).

In accordance with a fourth aspect of the present invention, there is provided a method of controlling at least one electrical device for an internal combustion engine in which a required operation period of time for each of the at least one electrical device which controls an operation of the internal combustion engine is computed by computing means in response to operating conditions of the engine, the computed required operation period of time is counted by time-counting means, and the each of the at least one electrical device is caused to operate during the counting by the time-counting means. The fourth aspect is characterized by comprising the following steps:

(a) outputting the operation starting signal for the each of the at least one electrical device from the computing means whenever the counting by the time-counting means is started;

(b) generating the interrupt signal when the counting by the time-counting means is completed;

(c) setting a difference obtained by subtracting a predetermined period of time from the required operation period of time, as a counting value of the time-counting means; and (d) outputting the operation ending signal when the predetermined period of time has elapsed after the generation of the interrupt signal from the time-counting means at the step (b).

Preferably, the predetermined period of time is set at a value larger than the longest period of time for the specific interval which is provided for the computing means and during which the control of the electrical devices is not started by an interrupt signal from the time-counting means.

Further preferably, the time-counting means comprises a single time counter.

The above and other objects, features, and advantages of the invention will be more apparent from the ensuing detailed description taken in conjunction with the accompanying drawings.

DETAILED DESCRIPTION

The method according to the invention will now be described in detail with reference to the drawings showing embodiments thereof.

Figure 1:
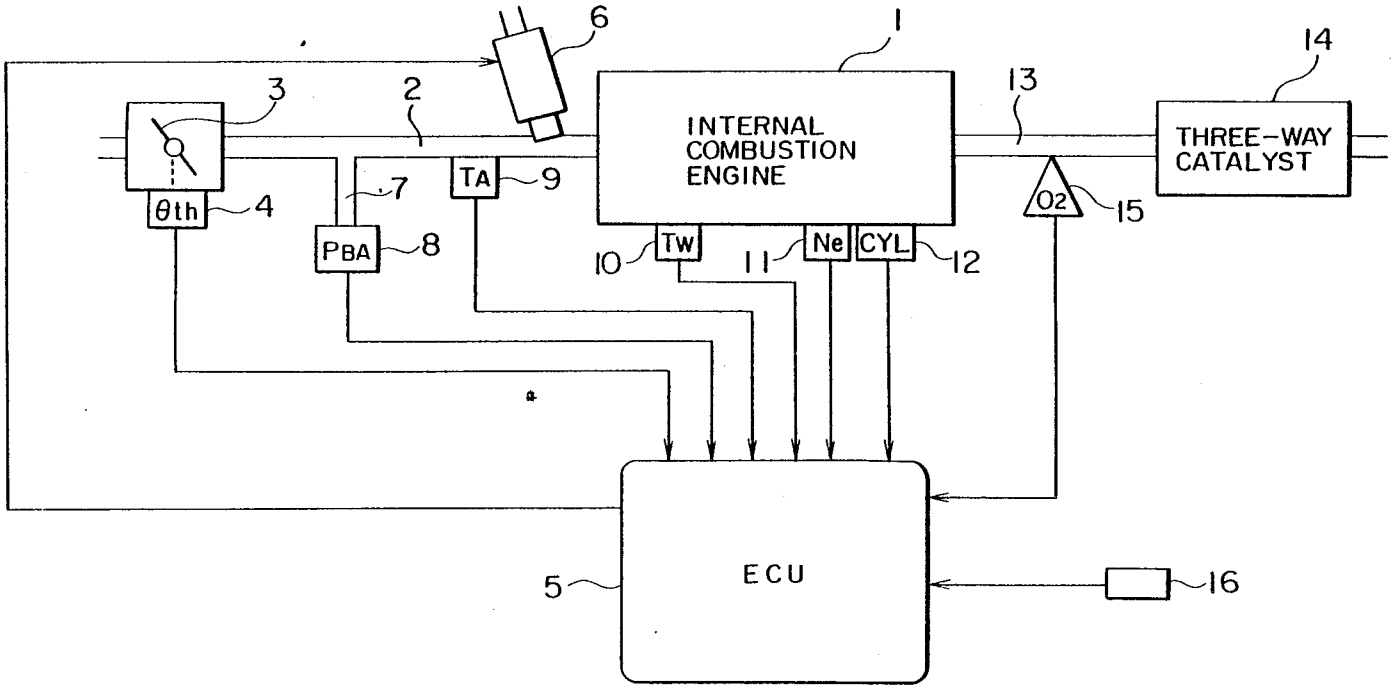
FIG. 1 is a block diagram illustrating the whole arrangement of a fuel supply control system for carrying out the method of the present invention.

Referring first to FIG. 1, there is shown the whole arrangement of a fuel supply control system for an internal combustion engine, which carries out the method according to the invention. In the figure, reference numeral 1 designates an internal combustion engine for automotive vehicles. Connected to the cylinder block of the engine 1 is an intake pipe 2 in which is arranged a throttle valve 3. A throttle valve opening ($\theta$th) sensor 4 is connected to the throttle valve 8 for generating an electric signal indicative of the sensed throttle valve opening and supplying same to an electronic control unit (hereinafter referred to as "the ECU") 5.

Fuel injection valves (hereinafter referred to as "injectors") 6 as electrical devices, only one of which is shown, are inserted into the interior of the intake pipe 2 at locations intermediate between the cylinder block of the engine 1 and the throttle valve 3 and slightly upstream of respective intake valves, not shown. The injectors 6 are connected to a fuel pump, not shown, and electrically connected to the ECU 5 to have their valve opening periods $T_{OUT}$ controlled by signals therefrom.

On the other hand, an intake pipe absolute pressure ($P_{BA}$) sensor 8 is provided in communication with the interior of the intake pipe 2 by way of a pipe 7 at a location immediately downstream of the throttle valve 8 for supplying an electrical signal indicative of the sensed absolute pressure withing the intake pipe 2 to the ECU 5. An intake air temperature ($T_A$) sensor 9 is inserted into the intake pipe 2 at a location downstream of the absolute pressure sensor 8 for supplying an electrical signal indicative of the sensed intake air temperature TA to the ECU 5.

An engine coolant temperature ($T_W$) sensor 10, which may be formed of a thermistor or the like, is mounted in the cylinder block of the engine 1, for supplying an electric signal indicative of the sensed engine coolant temperature $T_W$ to the ECU 5. An engine rotational speed (Ne) sensor 11 and a cylinder-discriminating (CYL) sensor 12 are arranged in facing relation to a camshaft or a crankshaft of the engine 1, neither of which is shown. The engine rotational speed sensor 11 generates a pulse as a TDC singal pulse whenever the crankshaft rotates through 240 degrees at predetermined crank angles, while the cylinder-discriminating sensor 12 generates a pulse at a predetermined crank angle of a particular cylinder of the engine, both of the pulses being supplied to the ECU 5.

A three-way catalyst 14 is arranged within an exhaust pipe 13 connected to the cylinder block of the engine 1 for purifying noxious components such as HC, CO, and NOx. An $O_2$ sensor 15 as an exhaust gas ingredient concentration sensor is mounted in the exhaust pipe 13 at a location upstream of the three-way catalyst 14, for sensing the concentration of oxygen present in exhaust gases emitted from the engine 1 and supplying an electric signal indicative of the sensed oxygen concentration to the ECU 5.

Further electrically connected to the ECU 5 are other sensors generically designated by 16 for sensing other engine operating parameters, such as atmospheric pressure and battery voltage, and supplying respective electric signals indicative of the sensed parameters.

The ECU 5 operates in response to the above-mentioned signals from the sensors to determine operating conditions in which the engine is operating such a fuel cut-effecting region, an accelerating region, and a decelerating region, and calculates, based upon the determined operating regions, the valve opening period or fuel injection period $T_{OUT}$ over which the injectors are to be opened, by the use of the following equation in synchronism with inputting of TDC signal pulses to the ECU 5:

$$T_{OUT} = T_i \times K_1 + K_2 \quad (1)$$

where Ti represents a basic value of the fuel injection period of the injectors 6, which is determined based upon the engine rotational speed Ne and the intake pipe absolute pressure $P_{BA}$.

$K_1$ and $K_2$ are correction coefficients and correction variables, respectively, which have their values calculated by the use of respective equations or tables on the basis of the values of the engine operating parameter signals from the aforementioned various sensors so as to optimize operating characteristics of the engine such as startability, emission characteristics, fuel consumption and accelerability.

The ECU 5 supplies the injectors 6 with driving signals corresponding to the calculated fuel injection period TOUT determined as above, over which the injectors 6 are opened.

Figure 2:
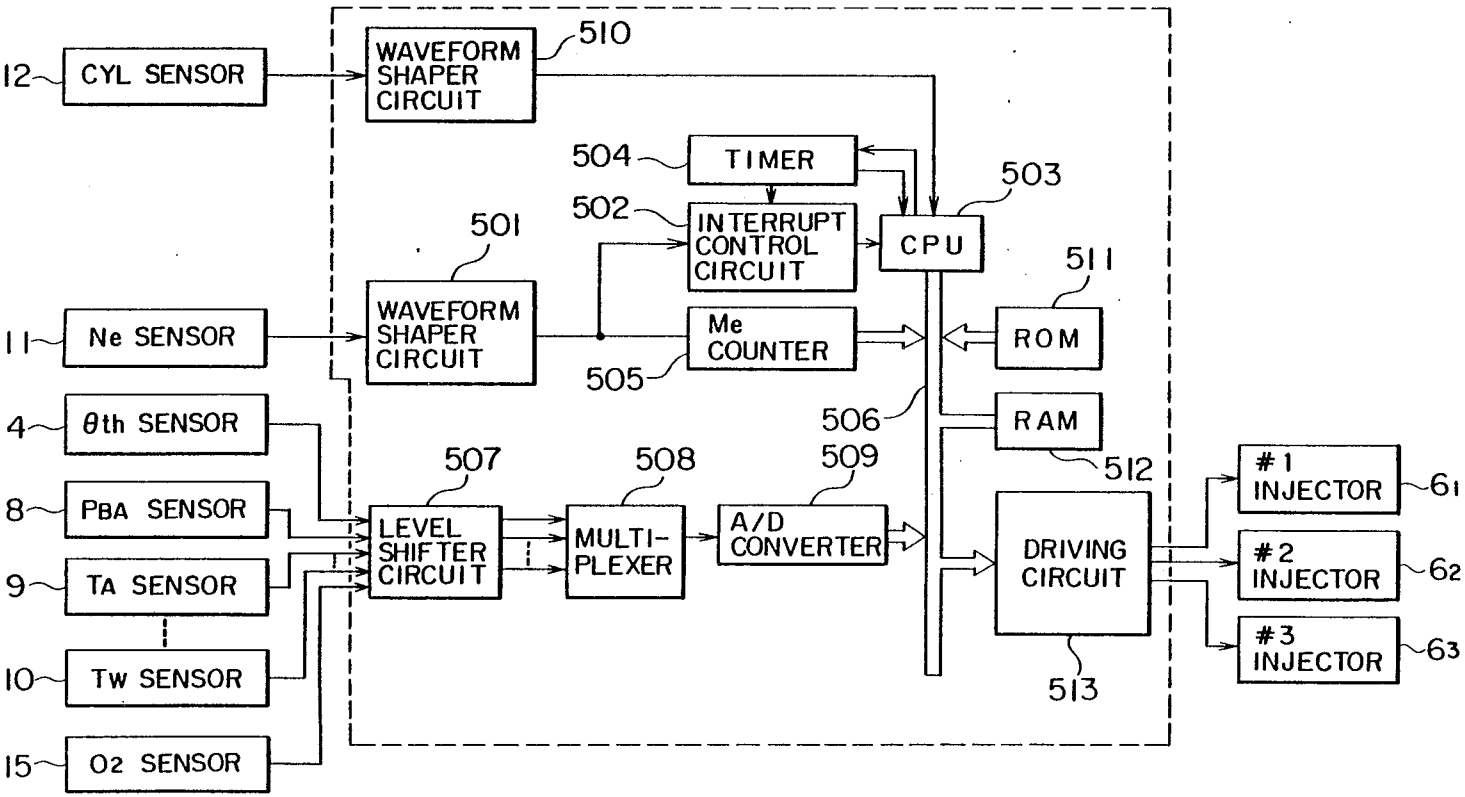
FIG. 2 is a block diagram illustrating the interior construction of an electronic control unit appearing in FIG. 1.

FIG. 2 shows the interior arrangement of the ECU 5 in FIG. 1. An output signal from the engine rotational speed sensor 11 has its waveform shaped by a waveform shaper circuit 501, and the shaped signal is supplied as TDC signal pulses to a central processing unit (hereinafter referred to as "the CPU") 503 by way of an interrupt control circuit 502. Connected to the interrupt control circuit 502 is a timer (time-counting means) 504 which comprises an up counter and the operation of which is controlled by the CPU 503. The timer 504 supplies its counted value to the interrupt control circuit 502 and the CPU 503, and the interrupt control circuit 502 supplies an interrupt signal to the CPU when the timer 504 has counted up. Further, the timer 504 automatically restarts counting by resetting the counted value to 0 upon counting-up, i.e., upon reaching an overflow value $T_{of}$, so fas as the CPU does not cause the operation of the timer 504 to stop.

The waveform shaper circuit 501 is also connected to an Me counter 505. The Me counter 505 counts the time interval between inputting of an immediately preceding pulse of the TDC signal from the engine rotational speed sensor and inputting of a present pulse of same, and its counted value Me is therefore proportional to the reciprocal of the engine rotational speed Ne. The Me counter 502 supplies the counted value Me to the CPU 503 via a data bus 506.

Output signals from the throttle valve opening sensor 4, the intake pipe absolute pressure sensor 8, the $O_2$ sensor 15, etc. shown in FIG. 1 are shifted in level to a predetermined level by a level-shifter circuit 507 and then the level-shifted signals are successively delivered by a multiplexer 508 to an A/D converter 509, where the level-shifted signals are converted to digital signals, which in turn are supplied to the CPU 503 via a data bus 506.

A signal from the cylinder-discriminating sensor 12 has its waveform shaped by a waveform shaper circuit 510, and the shaped signal is supplied as a CYL signal pulse to the CPU 503.

Further connected to the CPU 503 via the data bus 506 are a read-only memory (ROM) 511, a random access memory (RAM) 512, and a driving circuit 513. The RAM 512 temporarily stores results of calculations executed by the CPU 503, and the ROM 511 stores a control program executed by the CPU 503, a Ti map for determining the basic fuel injection period Ti for the injectors 6 on the basis of engine rotational speed Ne and intake pipe absolute pressure $P_{BA}$, etc.

The CPU 503 executes the control program stored in the ROM 511 to calculate the fuel injection period $T_{OUT}$ for the injectors 6 in accordance with the various engine operating parameter signals, sets a timer set value $T_{SET}$ for the timer 504 on the basis of the calculation results to thereby start the operation of the timer 504, selects an injector 6 which is to carry out an injection corresponding to an inputted TDC signal pulse out of #1 to #3 injectors $6_1$ to $6_3$ provided for the first to third cylinders, respectively, and supplies a control signal for opening the selected injector to the driving circuit 513. Further, the CPU selects an injector 6 which is to terminate an injection out of the injectors $6_1$ to $6_3$ carrying out injections when the timer 504 has counted up, and supplies a control signal for closing the selected injector to the driving circuit 513. The driving circuit 513 supplies a driving signal to the proper injector 6 from the time the control signal for opening the injector 6 is inputted to the circuit to the time the control signal for closing same is inputted to the circuit.

Figure 3:
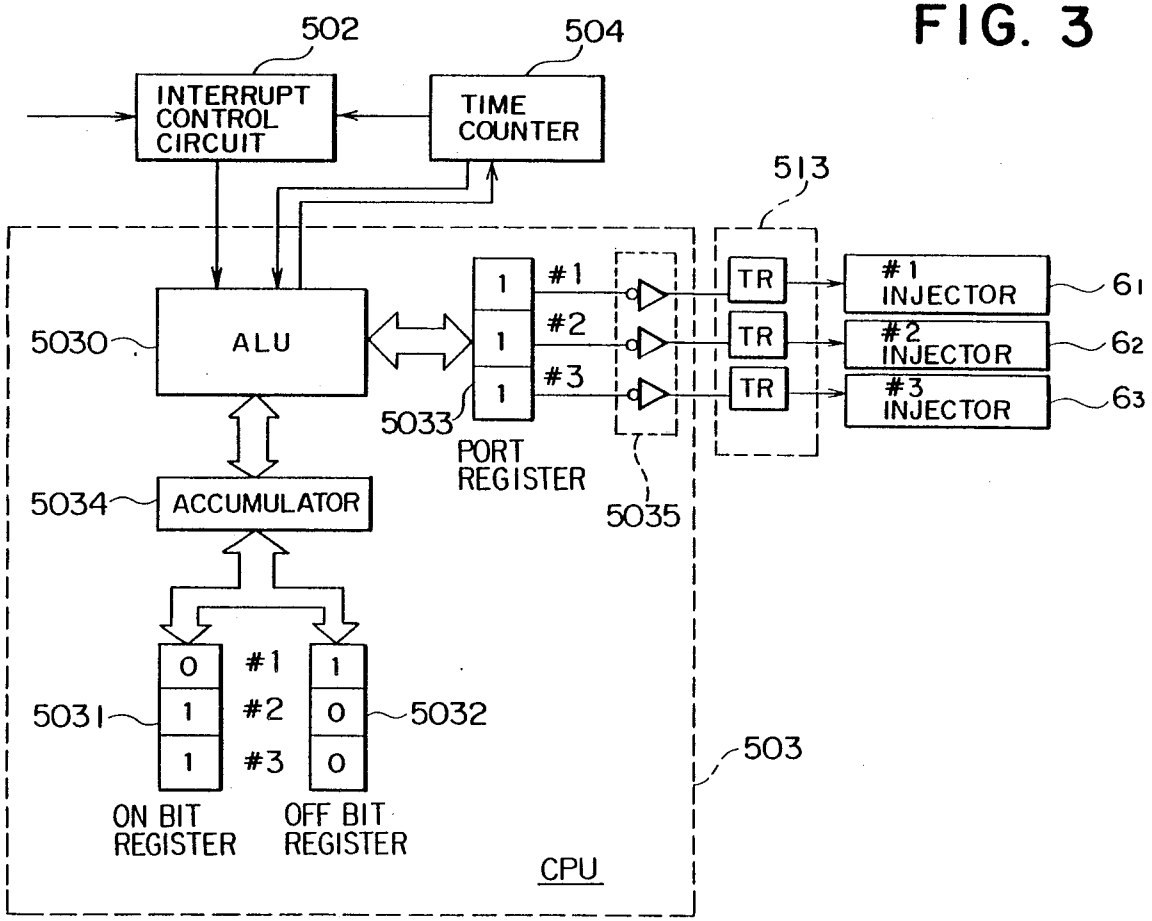
FIG. 3 is a schematic block diagram showing detailed construction of part of the electronic control unit of FIG. 2.

FIG. 3 shows the interior construction of the CPU 503 and the driving circuit 513 shown in FIG. 2 as well as circuits connected thereto. The CPU 503 comprises an arithmetic and logic unit (hereinafter called "the ALU") 5030, an injector-on-bit register 5031 and an injector-off-bit register 5032, both connected to the ALU 5030 by way of an accumulator 5034, an injector port register 5033 connected to the ALU 5030 and having the same number of bits as that of cylinders of the engine, and an invertor circuit 5035 having invertor elements each corresponding to respective bits of the injector port register 5033.

The injector-on-bit register 5031 and the injector-off-bit register 5032 each comprise a ring counter having the same number of bits (3 bits) as that of the cylinders. More specifically, in the injector-on-bit register 5031, only one bit indicates a value of 0, and the rest indicate a value of 1. In response to each control pulse from the ALU 5030, the value of 0 moves to an adjacent bit in the order of #1, #2, #3, #1, . . . , i.e., thus the injector-on-bit register 5031 is updated. In the injector-off-bit register 5032, only one bit indicates a value of 1, and the rest indicated a value of 0. In response to each control pulse from the ALU 5030, the value of 1 moves to an adjacent bit in the order of #1, #2, #3, #1, . . . , i.e., thus the injector-off-bit register 5032 is updated.

An output from each bit of the injector port register 5033 is inverted at the invertor circuit 5035, and then supplied to a corresponding transistor circuit TR of the driving circuit 513, to thereby control the commencement and termination of fuel injection from injectors $6_1$ to $6_3$.

Figure 4:
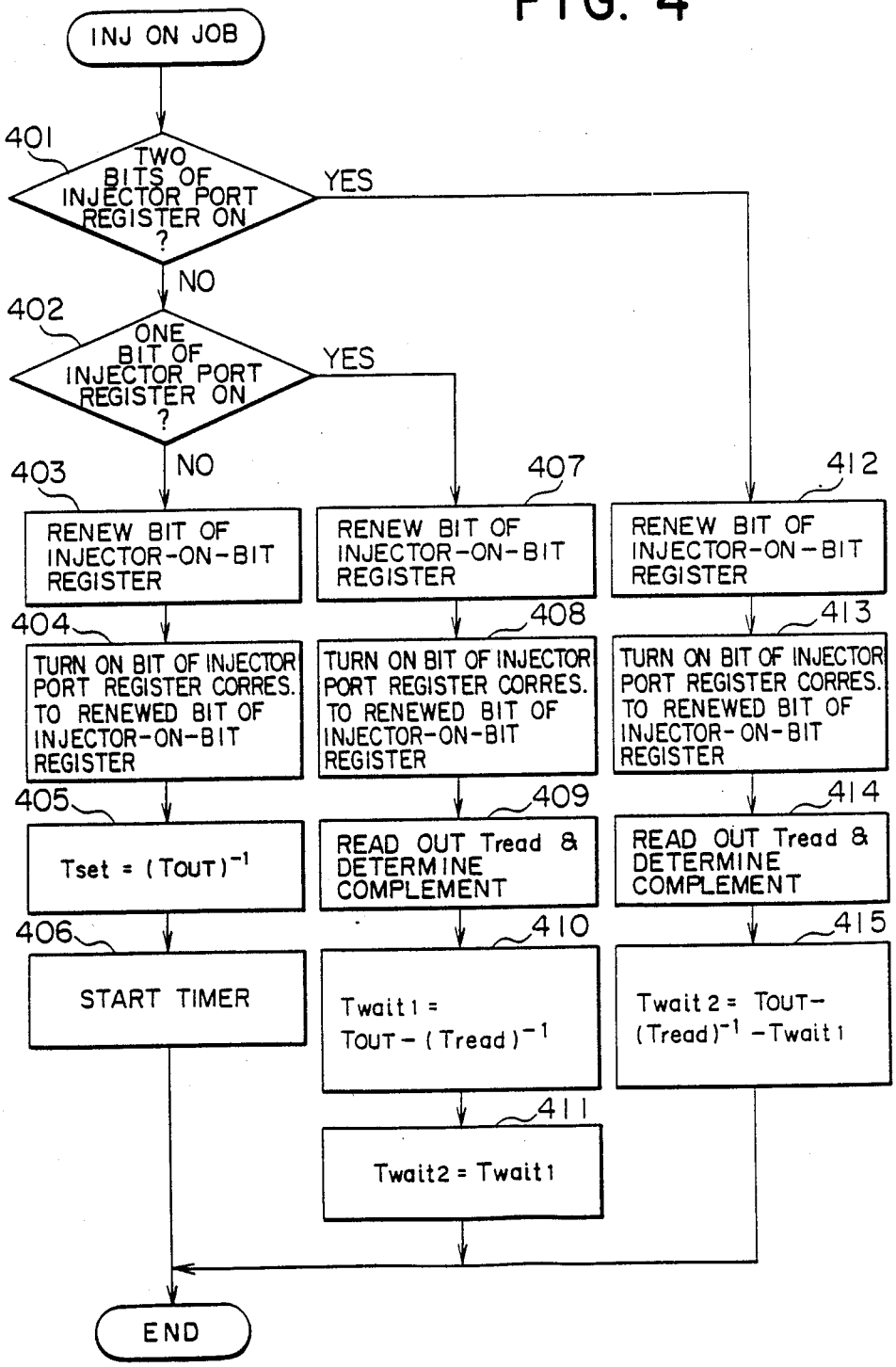
FIG. 4 is a flowchart of a control program for selecting and energizing fuel injection valves (injectors) according to a first embodiment of the invention.
Figure 5:
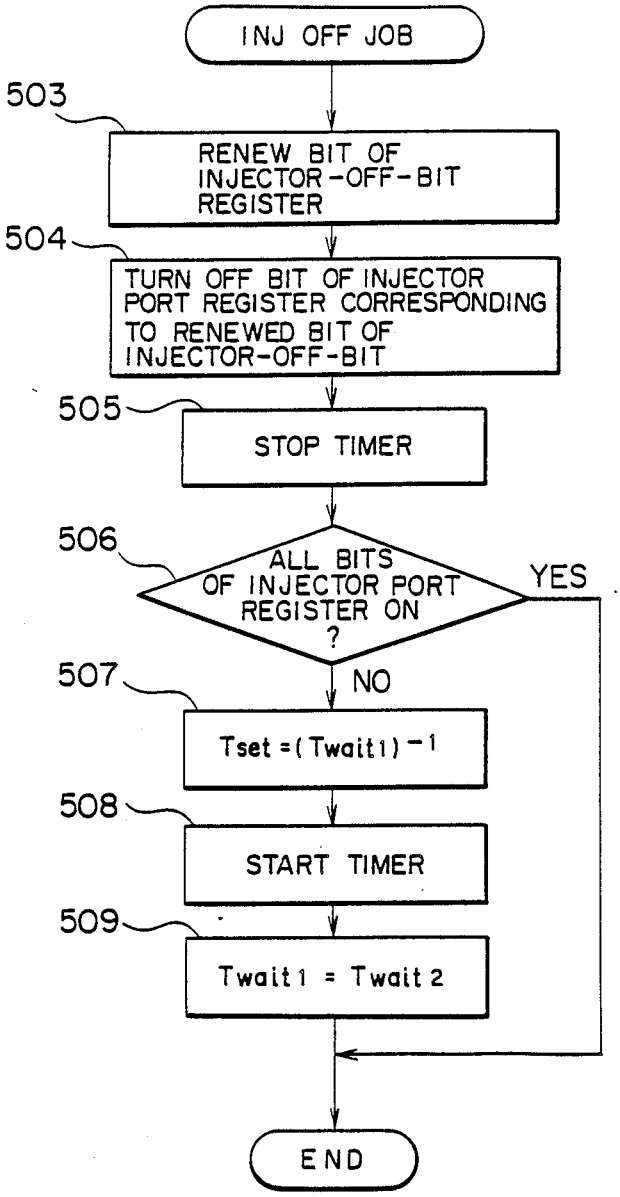
FIG. 5 is a flowchart of a control program for deenergizing the fuel injection valves (injectors) according to the first embodiment of the invention.

FIG. 4 and FIG. 5 are flowcharts illustrating the fuel supply control program according to a first embodiment of the invention. These flowcharts will be explained below with reference to the timing charts shown in FIGS. 6 to 8.

FIG. 4 is a routine for selection and energization (opening) of injectors 6. The control program is executed whenever each TDC signal pulse is generated and simultaneously upon completion of the calculation of the fuel injection period $T_{OUT}$ for each injector 6 which is carried out when the TDC signal pulse is generated.

Figure 6:
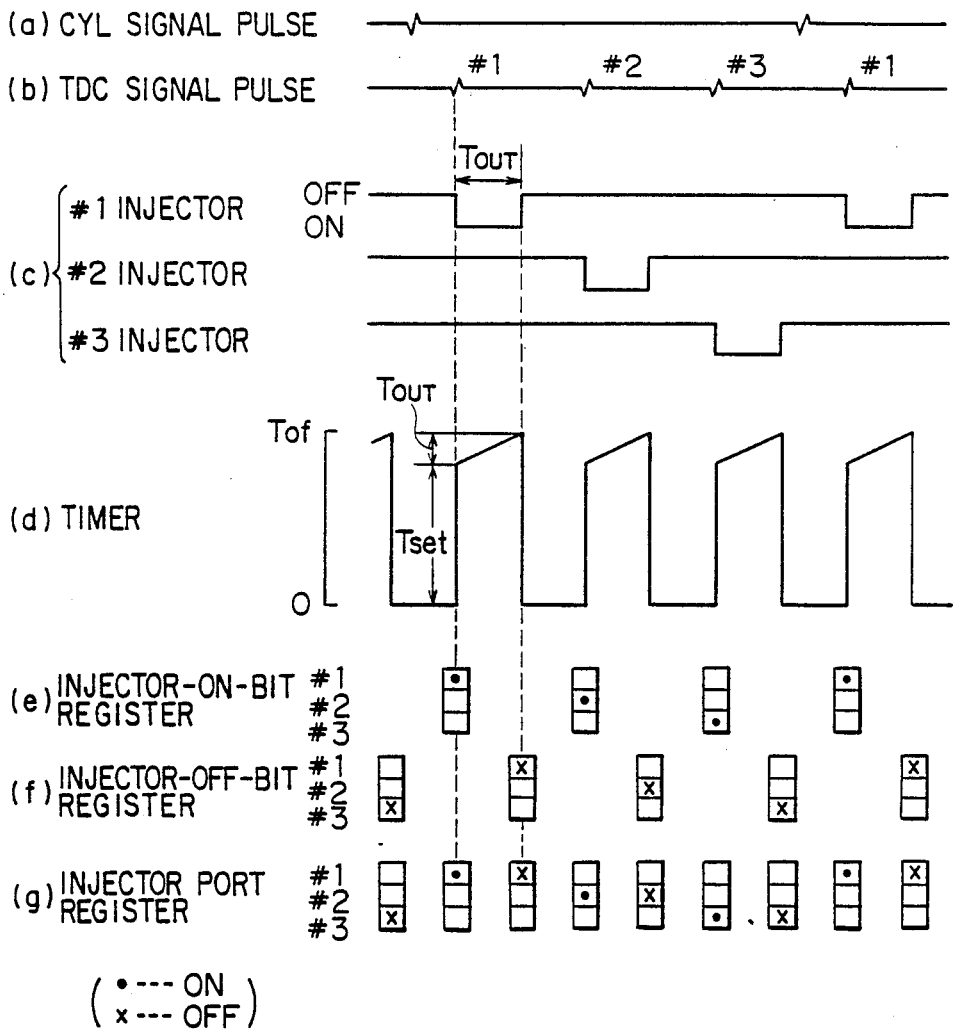
FIG. 6 is a timing chart of fuel injection timing, operating periods of time counters based on the control programs illustrated in FIGS. 4 and 5, etc. under a non-overlap condition.

First, it is determined at a step 401 whether two bits of the injector port register 5033 in FIG. 3 are in ON state (high-level state) or not. The injector port register 5033 as a flag has as many bits as the cylinders, and as will be described hereinbelow, while a bit corresponding to an injector 6 is held in its ON state, the injector 6 is held in an open state,. Accordingly, the number of bits of the injector port register 5033 which are in ON state represents the number of injectors 6 which are carrying out injection. If the answer to the question of step 401 is negative (NO), i.e., if the number of injectors carrying out injection is not two, it is then determined at a step 402 whether one bit of the injector port register 5033 is in ON state or not. If the answer is negative (NO), i.e., if all the bits of the injector port register 5033 are in OFF state, it is determined that none of the injectors 6 are carrying out injection of fuel, and then the program proceeds to steps 403 to 406 wherein control under the non-overlap condition under which only one injector 6 carries out fuel injection is executed. FIG. 6 shows a timing chart at the time of the non-overlap condition.

At the step 403, the injector-on-bit register 5031 in FIG. 3 as a flag is renewed or updated. This renewal or updating is effected by determining a cylinder for which fuel is to be injected from a CYL signal pulse ((a) in FIG. 6) which has already been inputted and a TDC signal pulse ((b) in FIG. 6) which has been inputted this time, i.e. in the present loop, and turning on a bit of the injector-on-bit register 5031 corresponding to the determined cylinder. The injector-on-bit register 5031 has as many bits as the cylinders as is the case with the above-described injector port register 5033 and the injector-off-bit register 5032 described hereinbelow, and the ON state of a bit is held until next renewal.

As shown in (a) and (b) of FIG. 6, for example, supposing that fuel injection is carried out successively for the first to third cylinders whenever a TDC signal pulse is generated after generation of each CYL signal pulse, if a first TDC signal pulse is inputted immediately after generation of a CYL signal pulse, it is determined that the cylinder for which fuel injection is to be carried out in the present loop is a first cylinder, and a bit of the injector-on-bit register 5031 corresponding to the first cylinder, i.e., #1 bit, is turned on to thereby renew the injector-on-bit register 5031 ((e) in FIG. 6), and thereafter renewal of the injector-on-bit register 5031 is sequentially effected in the order of #2, #3, #1, . . . each time a TDC signal pulse is generated.

Then the program proceeds to a step 404, where a bit of the injector port register 5033 corresponding to the bit of the injector-on-bit register 5031 which has been turned on at the step 403 is turned on, and simultaneously a control signal for energizing a corresponding injector 6 is supplied to the driving circuit 513. This starts the injection of fuel from the corresponding injector 6 ((c) in FIG. 6). For example, if #1 bit of the injector-on-bit register 5031 has been turned on at the step 403, #1 bit of the injector port register 5033 is turned on, and a control signal for energizing #1 injector $6_1$ is outputted to thereby start fuel injection for the corresponding first cylinder.

Next, the program proceeds to a step 405, where the complement $(T_{OUT})^{-1}$ of the fuel injection period $T_{OUT}$ which has already been calculated is set as a timer set value $T_{set}$ in the timer 504, and then at a step 406 the operation of the timer 504 is started ((d) in FIG. 6) to thereby terminate the present program. The reason why the complement $(T_{OUT})^{-1}$ of the fuel injection period $T_{OUT}$ is employed as the timer set value $T_{set}$ in the timer 504 is that the timer 504 comprises an up counter as mentioned before.

The control program of FIG. 5 is for deenergization (closing) of the injectors 6. This program is executed whenever the timer 504 counts up and an interrupt signal is inputted to the CPU 503 from the interrput control circuit 502. In other words, under the non-overlap condition, the control program of FIG. 5 is executed as soon as the counted value of the timer 504 the operation of which has been started at the step 406 reaches the overflow value $T_{of}$ ((d) in FIG. 6).

First, at a step 503, the injector-off-bit register 5032 in FIG. 3 as a flag is renewed with respect to a bit thereof corresponding to an injector 6 which is to terminate injection this time. This renewal or updating is effected, for example, by detecting bits of the injector port register 5033 which are in the ON state and turning off a bit of the injector-off-bit register 5032 corresponding to one of the bits of the injector port register 5038 in the ON state corresponding to a cylinder for which fuel injection has been started earliest. Since under the non-overlap condition, only one injector 6 is carrying out fuel injection, the bit of the injector-off-bit register 5032 to be renewed corresponds to the bit of the injector-on-bit register 5031 which has been renewed at 403 in FIG. 4 immediately before execution of the present program ((e) and (f) in FIG. 6).

Next, the program proceeds to a step 504, where a bit of the injector port register 5033 corresponding to the bit of the injector-off-bit register 5032 which has been renewed at the step 503 is turned off ((g) in FIG. 6), and simultaneously a control signal for deenergizing a corresponding injector 6 is supplied to the driving circuit 513. This terminates the fuel injection from the corresponding injector 6 ((c) in FIG. 6). For example, if #1 bit of the injector-off-bit register 5032 is turned off at the step 503 #1 bit of the injector port register 5033 is turned off, and a control signal for deenergizing #1 injector $6_1$ is supplied to the driving circuit 513 ((f) and (g) in FIG. 6), to thereby stop the fuel injection into the corresponding first cylinder ((c) in FIG. 6).

Then, the program proceeds to a step 505, where the operation of the timer 504 is stopped ((d) in FIG. 6), and then to a step 506, where it is determined whether all of the bits of the injector port register 5033 are in the OFF state (low-level state), i.e., whether none of the injectors 6 are carrying out fuel injection or not. Since under the non-overlap condition, none of the injectors 6 are carrying out fuel injection immediately after one injector has stopped fuel injection, the answer to the step 506 should be affirmative (Yes) so that the present program is terminated.

Under the non-overlap condition, the process described above is repeatedly carried out, whereby actual periods of time for fuel injection by the injectors $6_1$ to $6_3$ are successively controlled to respective calculated fuel injection periods $T_{OUT}$.

Figure 7:
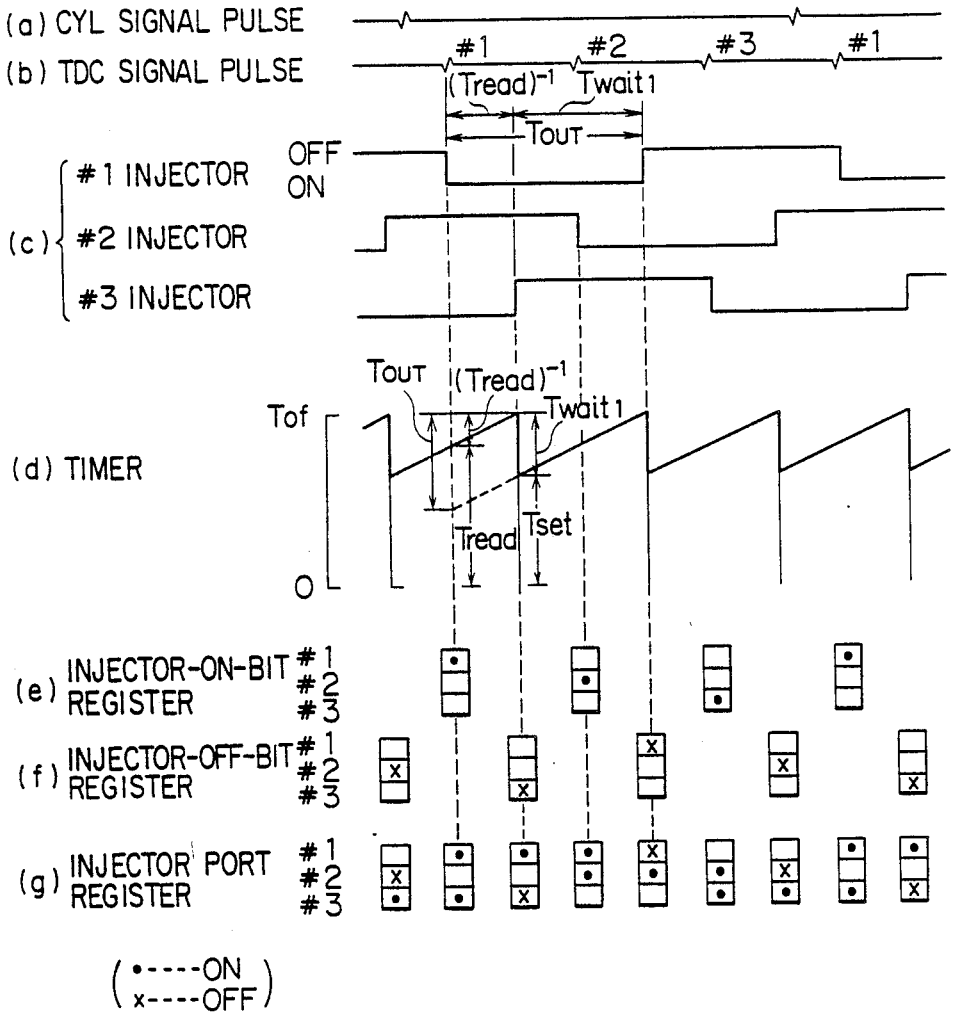
FIG. 7 is a timing chart similar to FIG. 6 under a 1-overlap condition.

Returning to the routinte in FIG. 4, if the answer to the step 402 is affirmative (Yes), i.e., if only one bit of the injector port register 5033 is already in the ON state, it is determined that one injector 6 is carrying out fuel injection, and at the following steps 407 to 411, control under the 1-overlap condition, i.e., control at the time fuel injection is simultaneously carried out by two injectors 6 is executed. FIG. 7 shows a timing chart under the 1-overlap condition.

First, at a step 407, similarly to the step 403 under the non-overlap condition, the injector-on-bit register 5031 is renewed with respect to a bit thereof corresponding to a TDC signal pulse which has been inputted this time, and then the program proceeds to a step 408, where a bit of the injector port register 5033 corresponding to the bit of the injector-on-bit register 5081 which has been renewed at the step 407 is turned on, and simultaneously a control signal for energizing a corresponding injector 6 is supplied to the driving circuit 513, to thereby start the fuel injection by the corresponding injector 6 ((b), (c), (e), and (g) in FIG. 7).

Next, the program proceeds to a step 409, where a timer-read value $T_{read}$ of the timer 504 which is in operation is read out. Under the 1-overlap condition, the timer 504 has been counting an energization period of time for an injector 6 which started fuel injection in the last loop when an immediately preceding TDC signal pulse was inputted. Therefore, the complement $(T_{read}^{-1}$ of the timer-read value $T_{read}$ of the timer 504 corresponds to a period of time left before the timer 504 counts up, i.e., the remainder of the energization period of time for the injector 6. For example, if a TDC signal pulse which has been inputted in the present loop is related to #1 injector $6_1$, the complement $(T_{read})^{-1}$ of the timer-read value $T_{read}$ at this time indicates a value corresponding to the remainder of the energization period of time for #3 injector $6_3$ which started fuel injection in the last loop ((c), and (d) in FIG. 7).

Then, the program proceeds to a step 410, where the difference between the fuel injection period $T_{OUT}$ set for the injector 6 which has started fuel injection in the present loop and the complement $(T_{read})^{-1}$ of the timer-read value $T_{read}$ which has been read out at the step 409 is stored as a first timer-set waiting term $T_{wait1}$, and then at a step 411 the first timer-set waiting term $T_{wait1}$ stored at the step 410 in the last loop is also set as a second timer-set waiting term Twait2, to thereby terminate the present program. In other words, under the 1-overlap condition, similarly to the case of the 2-overlap condition, which will be described hereinbelow, only the setting and storing of timer-set value $T_{set}$ are carried out in the present program, and the operation of the timer 604 is controlled by the rountine shown in FIG. 5.

Next, when the timer 504 which has been counting the energization period of time for the injector 6 which started fuel injection in the last loop of the routine shown in FIG. 4 has counted up, an interrup signal is generated to thereby start the routine shown in FIG. 5.

First, at the step 503, the injector-off-bit register 5032 is renewed. In other words, under the 1-overlap condition, the injector 6 which started to be energized in the last loop of the routine of FIG. 4 is to stop fuel injection, the injector-off-bit register 5032 is renewed with respect to a bit thereof corresponding to this injector 6. For example, if #1 injector $6_1$ has started fuel injection in the present loop of the routine of FIG. 4, #3 bit of the injector-off-bit register 5032 corresponding to the injector 6 which started fuel injection in the last loop of the routine of FIG. 4, i.e., #3 injector $6_3$ is renewed or turned off ((f) in FIG. 7).

Then the program proceeds to the step 504, where a bit of the injector port register 5033 corresponding to the bit of the injector-off-bit register 5032 which has been renewed at the step 503 is turned off, and simultaneously a control signal for deenergizing the corresponding or #3 injector $6_3$ is outputted to thereby terminate the fuel injection by the injector 63 ((c), and (g) in FIG. 7).

Next, the step 505 is executed to thereby stop the operation of the timer 504, and then the step 506 is executed. Under the 1-overlap condition, the answer to the step 506 should be negative (No), and then the program proceeds to a step 507.

At the step 507, the timer set value $T_{set}$ of the timer 504 is set to the complement $(T_{wait1})^{-1}$ of the first timer-set waiting term $T_{wait1}$ which was set at the step 410 in FIG. 4, and then at a step 508 the operation of the timer 504 is started ((d) in FIG. 7), and further at a step 509 the first timer-set waiting term $T_{wait1}$ is set to the second timer-set waiting term $T_{wait2}$ which was set at the step 411 in FIG. 4, followed by terminating the present program.

As described above, under the 1-overlap condition, when a TDC signal pulse is inputted, simultaneously a corresponding injector 6 starts to carry out fuel injection and at the same time the complement $(T_{read})^{-1}$ of a present timer-read value $T_{read}$ of the timer 504 is determined, which corresponds to the remainder of an energization period of time for another injector 6 which started to carry out fuel injection when an immediately preceding TDC signal pulse was inputted, and the difference between the fuel injection period $T_{OUT}$ and the complement $(T_{read})^{-1}$ the timer-read value is stored. Thereafter, when the timer 504 has counted up, i.e., when $(T_{read})^{-1}$ has elapsed after the fuel injection started, the fuel injection from the another injector 6 is stopped, the stored value is set into the timer 504, and the operation of the timer 504 is started. When the timer 504 has counted up, i.e., when the period of time $T_{OUT}-(T_{read})^{-1}$ has elapsed from the restarting of the operation of the timer 504, the fuel injection from the corresponding injector 6 is stopped. Therefore, by repeatedly carrying out the above-described process, fuel injections by respective injectors $6_1$ to $6_3$ can be controlled to preset fuel injection periods $T_{OUT}$ and timing thereof.

Figure 8:
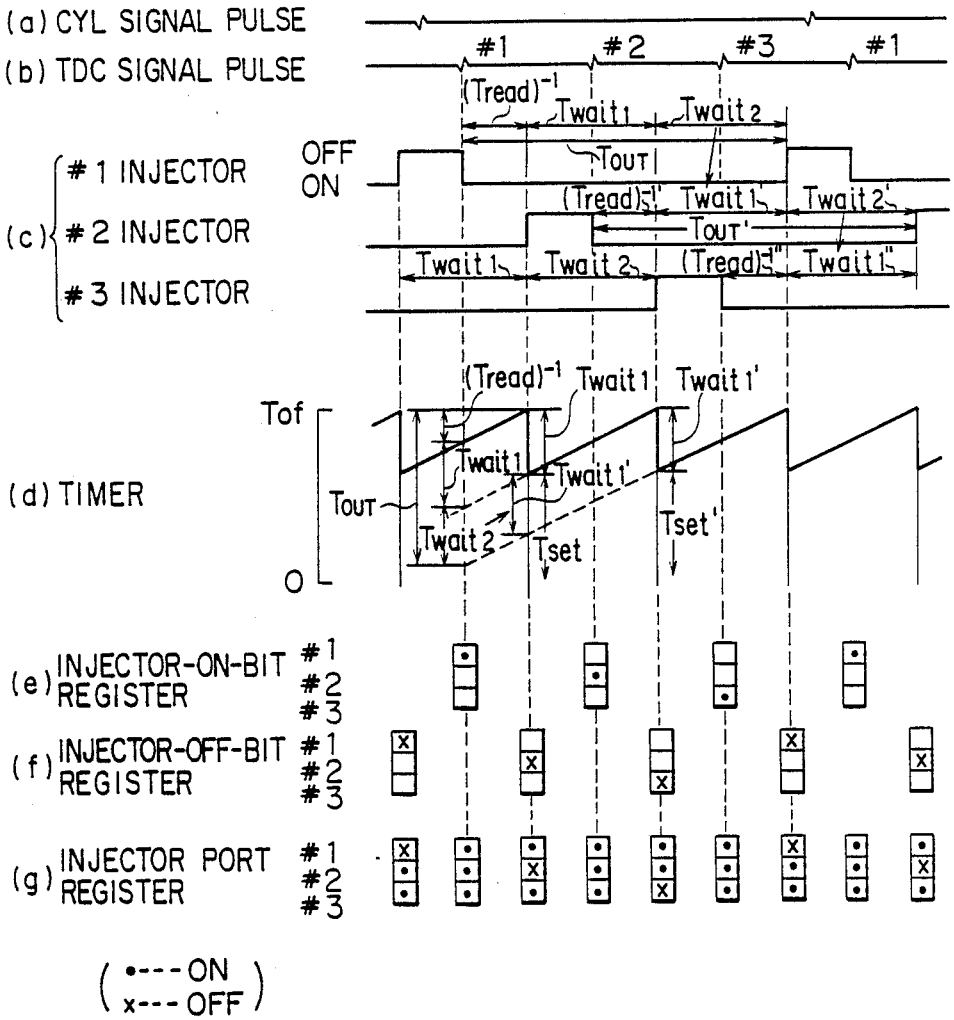
FIG. 8 is a timing chart similar to FIG. 6 under a 2-overlap condition.

Returning to the routine shown in FIG. 4, when the answer to the step 401 is affirmative (Yes), i.e., when two bits of the injector port register 5033 are already in the ON state, it is determined that two injectors are carrying out fuel injection, and the program proceeds to the following steps 412 to 415, where control under the 2-overlap condition, i.e., control at the time 3 injectors $6_1$ to $6_3$ simultaneously carry out fuel injection is executed. FIG. 8 shows a timing chart under the 2-overlap condition.

First, at a step 412, similarly to the cases of the non-overlap condition and the 1-overlap condition (step 403 and step 407), the injector-on-bit register 5031 is renewed with respect to a bit thereof corresponding to a TDC signal pulse which has been inputted this time, and then the program proceeds to a step 413, where similarly to the step 404 and the step 408, a bit of the injector port register 5033 corresponding to the renewed bit of the injector-on-bit register 5031 is turned on and simultaneously a control signal for energizing a corresponding injector 6 is outputted to thereby start the fuel injection by the corresponding injector ((b), (c), (e), and (g) of FIG. 8), Then, the program proceeds to a step 414, where the complement $(T_{read})^{-1}$ of a present timer-read value $T_{read}$ is determined. Under the 2-overlap condition, the complement $(Tread)^{-1}$ of a present timer-read value $T_{read}$ indicates a value corresponding to the remainder of an energization period of time for an injector 6 which started fuel injection in the second latest loop (loop immediately before the last loop), i.e, when a second latest TDC signal pulse was inputted ((c), and (d) in FIG. 8).

Then, at a step 415, a value obtained by subtracting the complement $(T_{read})^{-1}$ of the timer-read value $T_{read}$ read out at the step 414 and a first timer-set waiting term $T_{wait1}$ set at the step 509 in FIG. 5 from a fuel injection period $T_{OUT}$ which has already been computed is set as a second timer-set waiting term $T_{wait2}$ to thereby terminate the present program. The first timer-set waiting term $T_{wait1}$ is, as is clear from the description of the step 507 in FIG. 5 hereinbelow, identical to the second timer-set waiting term $T_{wait2}$ set at the step 415 in the last loop.

Next, when the timer 504 has counted up, the routine in FIG. 5 starts to be executed. First, at the step 503, the injector-off-bit register 5032 is renewed. In other words, under the 2-overlap condition, an injector 6 which started fuel injection earliest is one which started fuel injection in the second latest loop of the routine in FIG. 4, and therefore the injector-off-bit register 5032 is renewed with respect to a bit thereof corresponding to this injector 6. For example, if #1 injector $6_1$ started fuel injection in the present loop of the routine in FIG. 4, #2 bit of the injector-off-bit register 5032 corresponding to an injector 6 which started fuel injection in the second latest loop, i.e., #2 injector $6_2$, is renewed or turned off ((f) in FIG. 8).

Next, similarly to the cases of the non-overlap condition and the 1-overlap condition, a bit of the injector port register 5033 corresponding to the renewed bit of the injector-off-bit register 5032 is turned off ((g) in FIG. 8), the fuel injection by the corresponding injector 6 (#2 injector $6_2$) is terminated (step 504) ((c) in FIG. 8), the operation of the timer 504 is stopped (step 505) ((d) in FIG. 8), and further the above-described step 506 is executed.

Under the 2-overlap condition, the answer to the step 506 should be negative (No), and then the program proceeds to the step 507, where the complement of the first timer-set waiting term $T_{wait1}$ is set into the timer 504 as a timer-set value $T_{set}$. As is clear from the step 415 in FIG. 4 and the step 509 in FIG. 5, the first timer-set waiting term $T_{wait1}$ is identical to the second timer-set waiting term $T_{wait2}$ set at the step 415 in the immediately preceding or latest loop of the routine in FIG. 4. Then, the timer 504 is restarted (step 508) ((d) in FIG. 8), and further the second timer-set waiting term $T_{wait2}$ set at the step 415 in the present loop of the routine in FIG. 4 is set to the first timer-set waiting term $T_{wait1}$ ($T_{wait1}$ in FIG. 8) (step 509) to thereby terminate the present program.

As described above, under the 2-overlap condition, upon inputting of a TDC signal pulse, a corresponding injector 6 starts fuel injection, and at the same time the complement $(T_{read})^{-1}$ of a present timer-read value $T_{read}$ of the timer 504 is determined as a value corresponding to the remainder of an energization period of time for an injector which started fuel injection when a second latest TDC signal pulse was inputted. A value obtained by subtracting the complement $(T_{read})^{-1}$ of the present timer-read value $T_{read}$ and a timer-set value set for an injector which started fuel injection upon inputting of an immediately preceding or latest TDC signal pulse, i.e., a first timer-set waiting term $T_{wait1}$, from a fuel injection period $T_{OUT}$ which has already been calculated is stored. Further, when the timer 504 has counted up twice, the stored difference is set in the timer 504, and the operation of the timer 504 is started. When the timer 504 has counted up, the fuel injection from the corresponding injector 6 is terminated. Therefore, by repeatedly carrying out the above process, fuel injections by respective injectors $6_1$ to $6_3$ can be controlled to preset fuel injection periods $T_{OUT}$ and timing thereof.

FIGS. 9 to 13 illustrate a second embodiment of the invention. The CPU 503 of this embodiment is provided with an interrupt-inhibit interval as described before, wherein an interrput signal outputted from the interrupt control circuit 502 when the timer 504 has counted up can be effective to execute the control for stopping fuel injection in FIG. 10 during an interval other than the interrupt-inhibit interval.

Figure 9:
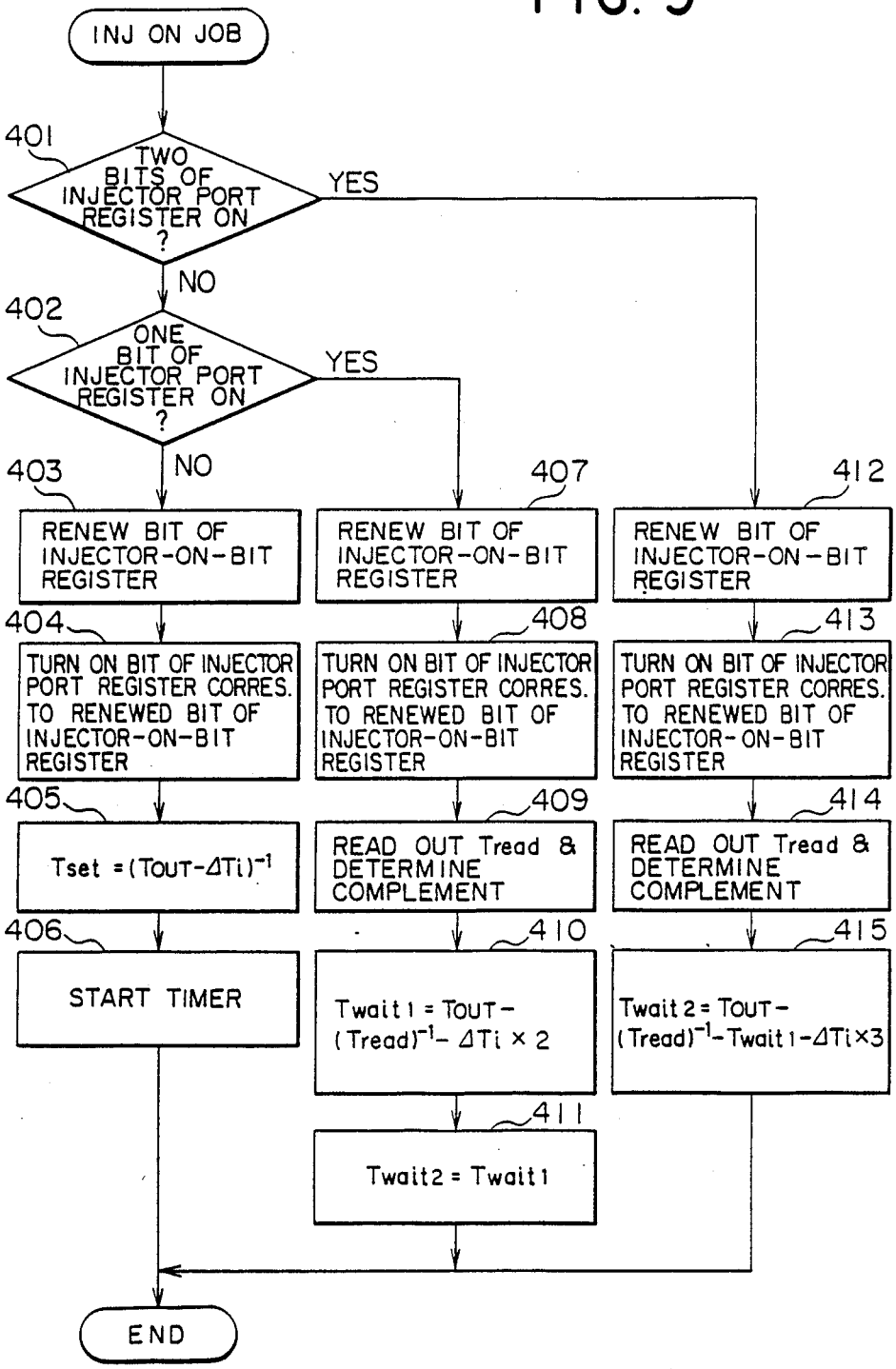
FIG. 9 is a flowchart similar to FIG. 4 according to a second embodiment of the invention.
Figure 10:
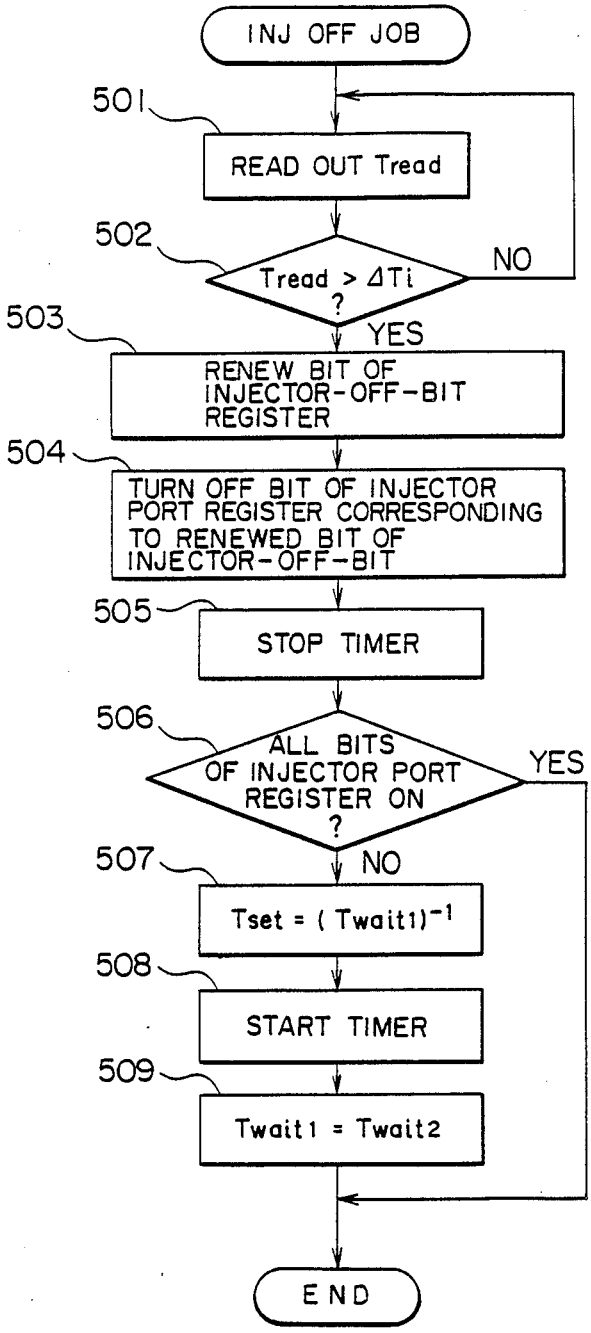
FIG. 10 is a flowchart similar to FIG. 5 according to the second embodiment of the invention.

FIGS. 9 and 10 are flowcharts illustrating the fuel supply control programs according to the second embodiment of the invention which are similar to FIGS. 4 and 5 of the first embodiment, respectively. In other words, since the CPU 503 is provided with the interrupt-inhibit interval in the second embodiment. FIG. 9 is different from FIG. 4 in the contents of the steps 405, 410, and 415, and FIG. 10 is different from FIG. 5 in that steps 501 and 502 are added to the introductory part of the program. However, the rest of the routines of FIGS. 9 and 10 is the same as that of FIGS. 4 and 5. In FIGS. 9 and 10, the steps are designated by identical numerals with respective corresponding steps in FIGS. 4 and 5.

According to the routine in FIG. 9, which is to be carried out under the non-overlap condition, at a step 405 the timer-set value $T_{set}$ for the timer 504 is set to the complement of the difference $(T_{OUT}-\Delta Ti)^{-1}$ between a fuel injection period $T_{OUT}$ which has already been calculated and a predetermined period of time $\Delta Ti$.

The predetermined period of time $\Delta Ti$ is set as a value slightly larger than the maximum value of the interrupt-inhibit interval of the CPU 503.

The routine of FIG. 10 is started when the timer 504 counts up, that is, when a value counted thereby reaches the overflow value $T_{of}$, and an interrupt signal outputted from the interrupt control circuit 502 is supplied to the CPU 503. More specifically, in the case where the time the timer 504 has counted up is not simultaneous with an interrupt-inhibit interval of the CPU 503, the present program is executed immediately upon counting-up of the timer 504, whereas in the case where the time the timer 504 has counted up is simultaneous with an interrupt-inhibit interval of the CPU 503, the present program is executed immediately upon ending of the interrput-inhibit interval ((c), and (e) in FIG. 11).

First, at a step 501 of FIG. 10, a present timer-read value $T_{read}$ is read out. The timer-read value $T_{read}$ indicates a value counted by the timer 504 which had its value reset to 0 upon counting-up and restarted counting from 0, i.e., a period of time elapsed after the timer 504 counted up ((e) in FIG. 11).

Then, the program proceeds to a step 502, where it is determined whether the timer-read value $T_{read}$ read out at the step 501 is larger than the predetermined period of time $\Delta Ti$. If the answer to the step 502 is negative. i.e., if $T_{read}=\Delta Ti$, which means that the predetermined period of time $\Delta Ti$ has not yet elapsed after the counter 504 counted up, the program returns to the step 501, and thereafter the execution of the steps 501 and 502 is repeated until the answer to the step 502 becomes affirmative (Yes).

If the answer to the step 502 is affirmative, i.e., if $T_{read}>\Delta Ti$, which means that the predetermined period of time $\Delta Ti$ has elapsed after the timer 504 counted up, the program proceeds to and carries out a step 503 et seq to thereby terminate the present program.

Figure 11:
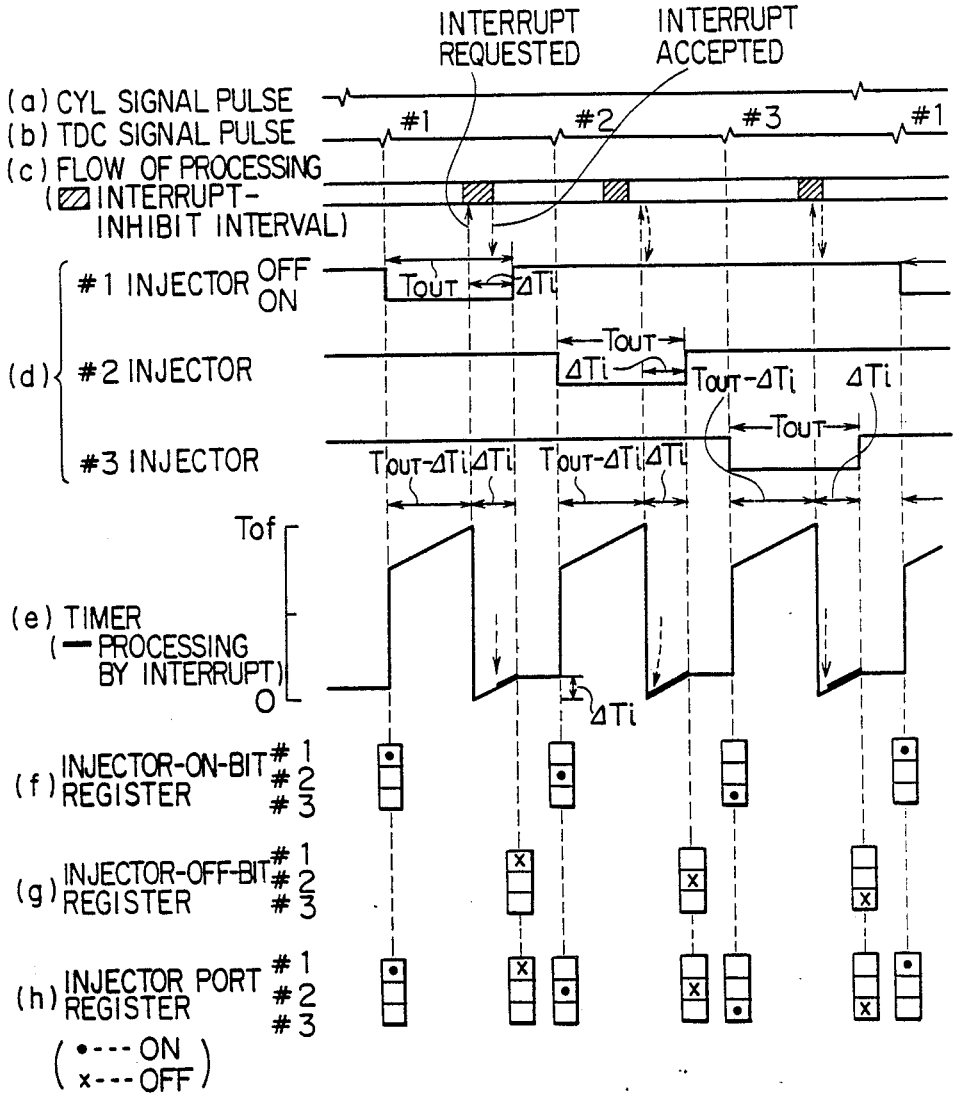
FIG. 11 is a timing chart of fuel injection timing, operating periods of time counters based on the control programs illustrated in FIGS. 9 and 10, under the non-overlap condition.

By execution of the above-described steps under the non-overlap condition, as shown in FIG. 11, when the fuel injection is started, simultaneously the complement of the difference between a desired fuel injection period $T_{OUT}$ which has been calculated and the predetermined period of time $\Delta Ti$ is set as a timer-set value for the timer 504 which starts counting the timer-set value (step 405), and the fuel injection is stopped when the predetermined period of time $\Delta Ti$ has elapsed after the timer 604 counted up (step 504). In this connection, as already described above, the predetermined period of time $\Delta Ti$ is set to a value larger than the maximum value of the interrupt-inhibit interval of the CPU 503. Therefore, even if the time the timer 504 has counted up belongs to the interrupt-inhibit interval, the interrupt-inhibit is necessarily cancelled before the predetermined period of time $\Delta Ti$ elapses, so that the interrupt signal is accepted by the CPU 503 ((c), (e) in FIG. 11. Therefore, the output of the control signal for deenergizing the injector 6 cannot be delayed, and fuel injection by a corresponding injector 6 is carried out for a desired or calculated fuel injection period $T_{OUT}$.

Under the non-overlap condition, the process described above is repeatedly carried out, whereby actual fuel injection periods of injectors $6_1$ to $6_3$ are successively controlled to preset fuel injection periods $T_{OUT}$.

Returning to the control program shown in FIG. 9, at a step 410 which is executed under the 1-overlap condition, the complement $(T_{read})^{-1}$ of a timer-read value $T_{read}$ read out at a step 409, and a period of time twice as long as $\Delta Ti$ are subtracted from a fuel injection period $T_{OUT}$ set for an injector 6 which has started fuel injection this time, and the difference thus obtained is set as a first timer-set waiting term $T_{wait1}$. The period of time twice as long as $\Delta Ti$ is subtracted because it is necessary to subtract the predetermined period of time $\Delta Ti$ to be applied at the time of deenergization of an injector 6 which started fuel injection in the last loop as well.

Then, when the timer 504 counts up and an interrupt signal is accepted by the CPU 503, the routine in FIG. 10 is started.

Figure 12:
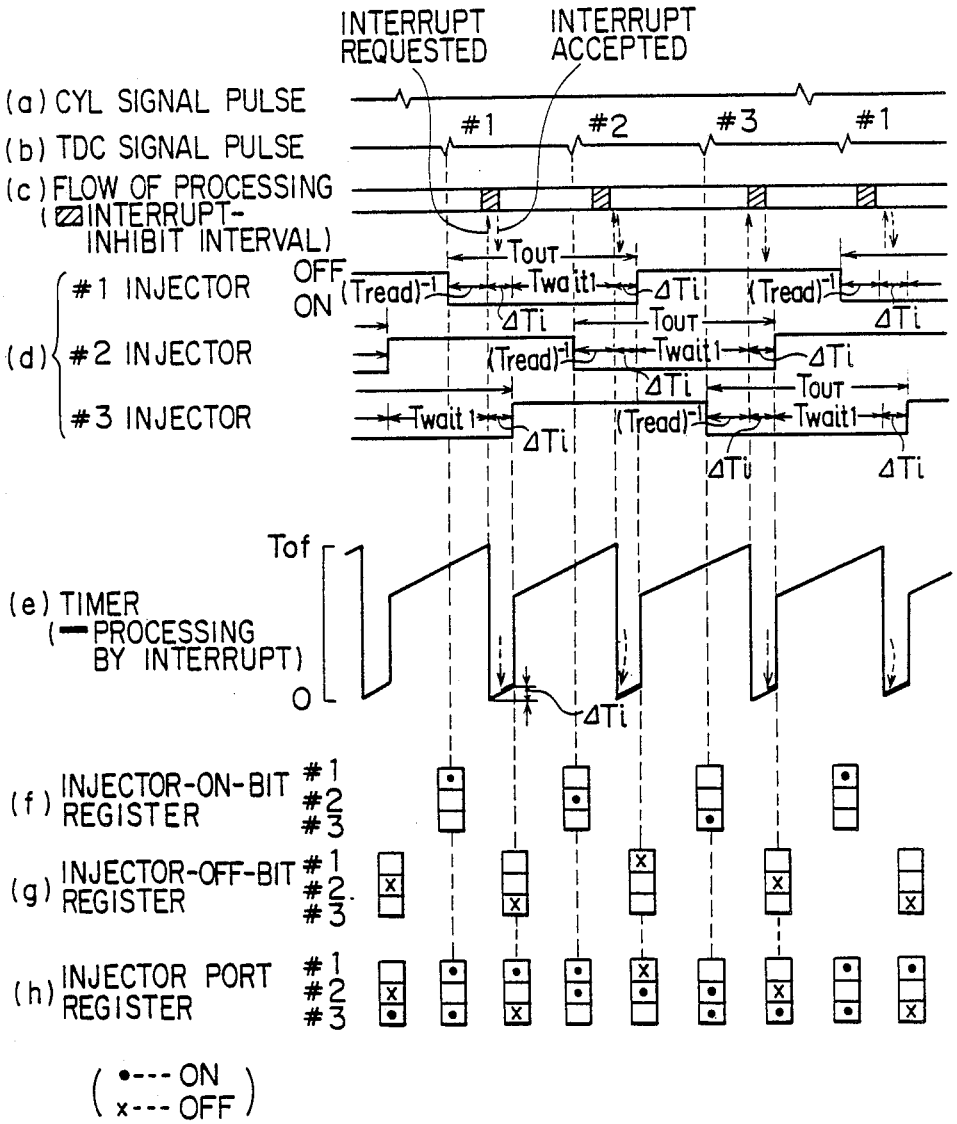
FIG. 12 is a timing chart similar to FIG. 11 under the 1-overlap condition.

Under the 1-overlap condition, as shown in FIG. 12, as soon as a TDC signal pulse is inputted to the CPU 503, fuel injection by a corresponding injector 6 is started. At the same time, a period of time from the starting of the timer to the counting-up thereof is read out as a timer-read value $T_{read}$, and a value $(TOUT-(Tread)^{-1}-\Delta Ti\times 2)$ obtained by subtracting the complement $(T_{read})^{-1}$ of the timer-read value $T_{read}$ and a value twice as long as the predetermined period of time $\Delta Ti$ from a calculated fuel injection period $T_{OUT}$ of the corresponding injector 6 is stored as $T_{wait1}$. Further, when $(T_{read})^{-1}+\Delta Ti$ has elapsed after the corresponding injector 6 started fuel injection, the above difference $(T_{OUT}-(T_{read})^{-1}-\Delta Ti\times 2)$ is set into the timer 504, and the timer 504 is restarted. Then, the timer 504 counts up when the period of time set in the timer $(T_{OUT}-(T_{read})^{-1}-\Delta Ti\times 2)$ has elapsed after the restart, and further, when the predetermined period of time $\Delta Ti$ has elapsed, fuel injection by the corresponding injector 6 is stopped. In other words, the fuel injection period of the injector 6 is the sum of a period of time from the start of the fuel injection to the restart of the timer 504 $((T_{read})^{-1}+\Delta Ti)$, the period of time set in the timer 504 $(T_{OUT}-(T_{read})^{-1}-\Delta Ti\times 2)$, and the predetermined period of time $\Delta Ti$. Thus the fuel injection period is controlled to the calculated value $T_{OUT}$. Further, similarly to the case of the non-overlap condition, the fuel injection by the corresponding injector 6 is stopped when the predetermined period of time ΔTi has passed after the timer 504 counted up, and therefore, irrespective of whether the point of time the timer 504 has counted up belongs to the interrupt-inhibit interval of the CPU 503, the fuel injection period of the corresponding injector 6 can be controlled to the desired or calculated value $T_{OUT}$.

Thereafter, the process described above is repeated, whereby fuel injection periods of respective injectors $6_1$ to $6_3$ are sequentially controlled to respective desired values TOUT.

Referring again to the routine of FIG. 9, at a step 415 carried out under the 2-overlap condition, a value obtained by subtracting the complement $(T_{read})^{-1}$ of a timer-read value $T_{read}$ read out at the step 414, a first timer-set waiting term $T_{wait1}$ set at the step 509 in FIG. 10, and a value three times as long as the predetermined period of time ΔTi, is set as a second timer-set waiting term $T_{wait2}$. Then, similarly to the control under the non-overlap condition or the 1-overlap condition, the routine of FIG. 10 is executed whenever the interrput signal is accepted by the CPU 503.

Figure 13:
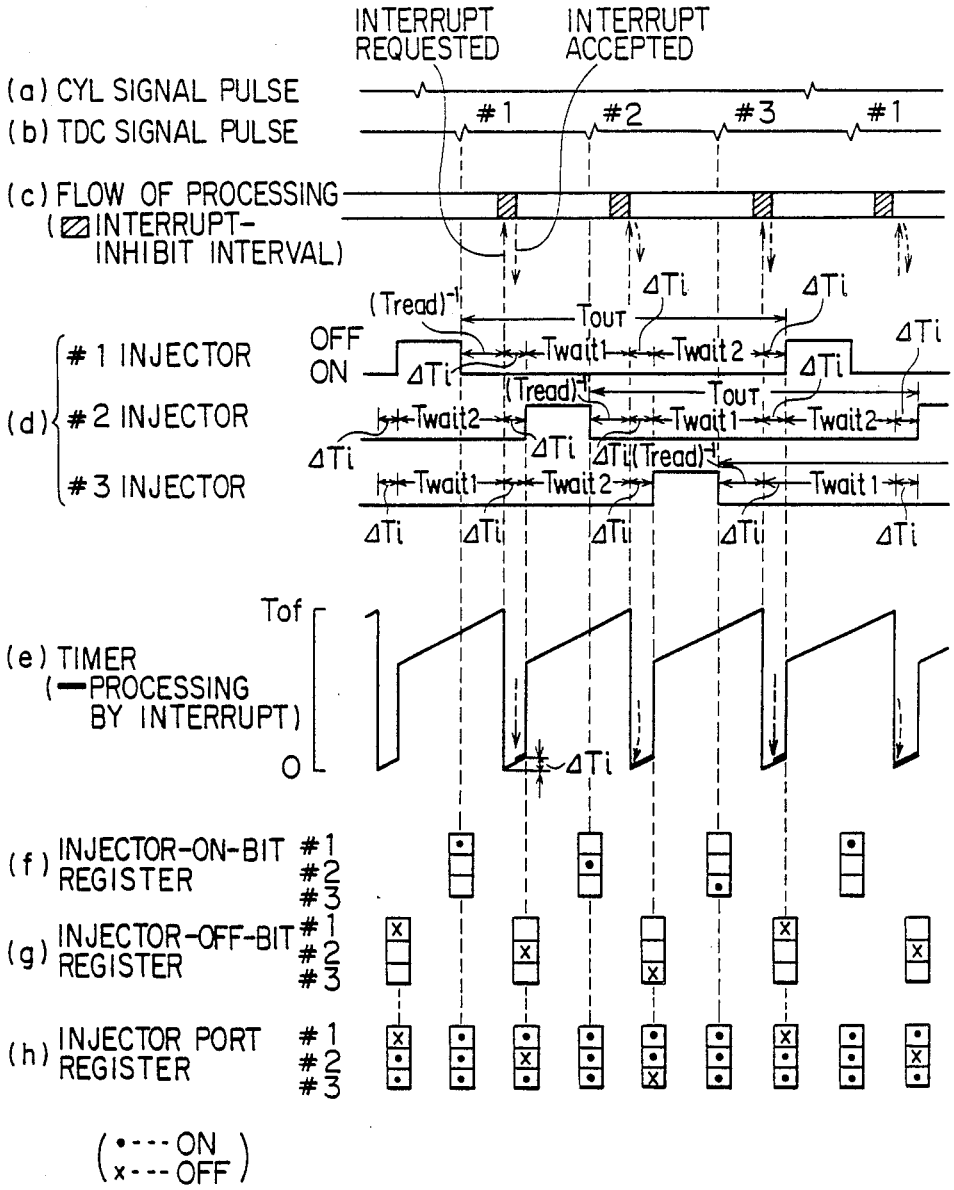
FIG. 13 is a timing chart similar to FIG. 11 under the 2-overlap condition.

Under the 2-overlap condition, as shown in FIG. 13, upon a TDC signal pulse being inputted to the CPU 503, a corresponding injector 6 starts fuel injection. At the same time, a period of time left before the counting-up of the timer is read out as the complement $(T_{read})^{-1}$ of a timer-read value $T_{read}$, and a value $(T_{OUT}-(T_{read})^{-1}-T_{wait1}-\Delta Ti\times 3)$ obtained by subtracting the complement $(T_{read})^{-1}$ of the timer-read value $T_{read}$, the first timer-set waiting term Twait1 set as a timer-set value for an injector which started fuel injection when the last TDC signal pulse was inputted to the CPU 503, and a value three times as long as the predetermined period of time ΔTi from a calculated fuel injection period $T_{OUT}$ of the injector 6 is stored as $T_{wait2}$. Thereafter, when $(T_{read})^{-1}+\Delta Ti)$ has elapsed after the injector 6 started fuel injection, the timer 504 is restarted. When $(T_{wait1}+\Delta Ti)$ has elapsed after the restart of the timer 504, the above difference $(T_{OUT}-(T_{read})^{-1}-T_{wait1}-\Delta Ti\times 3)$ is set into the timer 504, and the timer 504 is restarted again. Then, the timer 504 counts up when the period of time set in the timer $(T_{OUT}-(T_{read})^{-1}-T_{wait1}-\Delta Ti\times 3)$ has elapsed after the second restart, and thereafter, when the predetermined period of time ΔTi has further elapsed, fuel injection by the injector 6 is stopped. In other words, the fuel injection period of the injector 6 is the sum of a period of time from the start of the fuel injection to the restart of the timer 504 $((T_{read})^{-1}+\Delta Ti)$, a period of time from the restart of the timer 504 to the second restart thereof $(T_{wait1}+\Delta Ti)$, a period of time from the second restart of the timer 504 to the counting up thereof $(T_{OUT}-(T_{read})^{-1}-T_{wait1}-\Delta Ti\times 3)$, and the predetermined period of time ΔTi. Thus the fuel injection period is controlled to the calculated value $T_{OUT}$. Further, similarly to the control under the non-overlap condition or the 1-overlap condition, irrespective of whether the point of time the timer 504 has counted up belongs to the interrupt-inhibit interval of the CPU 503, the fuel injection period of the corresponding injector 6 can controlled to the desired value $T_{OUT}$.

Although, in the first and second embodiments described above, a single timer is employed as time counting means, the invention may be also carried out by the use of two or more time counting means. However, such control of electrical devices by the use of a single time counting means as in the embodiments, will contribute to reduction of the manufacturing cost of the control system.

Further, although in the first and second embodiments described above, three injectors are controlled as electrical devices, it is to be understood that the invention is not limited to them, but that various changes and modifications, particularly With respect to the kind and number of electrical devices, may be made in the invention without departing from the spirit and scope thereof.

What is claimed is:

1. A method of controlling a plurality of electrical devices which control an operation of an internal combustion engine wherein a required operation period of time for which each of said electrical devices is to be operated is computed by computing means in response to operating conditions of the engine, the computed required operation period of time is counted by at least one time-counting means, and said each of said electrical devices is caused to operate while said time-counting means is operating, the method comprising the steps of:

(a) outputting an operation starting signal for starting a different one of said electrical devices from said computing means whenever counting by said time-counting means is started;

(b) generating an interrupt signal when the counting by said time-counting means is completed;

(c) outputting an operation ending signal for ending the operation of said different one of said electrical devices from said computing means in response to the generation of said interrupt signal;

(d) detecting whether another one of said electrical devices is operating, at the time of the outputting of said operation starting signal for said different one of said electrical devices at the step (a);

(e) reading an actual counted value in said time-counting means for said another one of said electrical devices, when said another one of said electrical devices is operating;

(f) determining the remainder of the computed required operation period of time for said another one of said electrical devices from the read actual counted value;

(g) calculating and storing a difference obtained by subtracting from the computed required operation period of time for said different one of said electrical devices the determined remainder of the computed operation period of time and a period of time twice as long as said predetermined period of time;

(h) setting the difference into said time-counting means when said interrupt signal is generated from said time-counting means at the step (b);

(i) restarting said time-counting means to count the set difference;

(j) generating an interrupt signal when the counting by said restarted time-counting means is completed; and (k) outputting an operation ending signal for said different one of said electrical devices from said computing means when said predetermined period of time has elapsed after the generation of said interrupt signal at the step (j).

2. A method of controlling a plurality of electrical devices which control an operation of an internal combustion engine wherein a required operation period of time for which each of said electrical devices is to be operated is computed by computing mean sin response to operating conditions of the engine, the computed required operation period of time is counted by at least one time-counting means, and said each of said electrical devices is caused to operate while said time-counting means is operating, the method comprising the steps of:

(a) outputting an operation starting signal for starting a different one of said electrical devices from said computing means whenever counting by said time-counting means is started;

(b) generating an interrupt signal when the counting by said time-counting means is completed;

(c) outputting an operation ending signal for ending the operation of said different one of said electrical devices from said computing means in response to the generation of said interrupt signal;

(d) detecting whether other electrical devices are operating, at the time of the outputting of said operation starting signal for said different one of said electrical devices at the step (a);

(e) determining the number n of said other electrical devices which are operating, when said other electrical devices are operating;

(f) reading an actual counted value in said time-counting means for an electrical device the operation of which was started earliest of said other electrical devices which are operating;

(g) determining the remainder of the computed required operation period of time for the earliest started electrical device from the read actual counted value;

(h) calculating and storing a different obtained by subtracting from the computed required operation period of time for said different one of said electrical devices the determined remainder of the computed required operation period of time, a counting value or counting values for the rest of said other electrical devices which are operating, and a period of time as (n+1) times as long as said predetermined period of time;

(i) setting the difference into said time-counting means when interrupt signals from said time-counting means have been produced n times;

(j) restarting said time-counting means to count the set difference;

(k) generating an interrupt signal when the counting by the restarted time-counting means is completed; and (l) outputting an operation ending signal for said different one of said electrical devices, from the computing means when said predetermined period of time has elapsed after the generation of said interrupt signal at the step (k).

3. A method as claimed in either of claims 1 or 2, wherein said predetermined period of time is set at a value which is larger than the maximum length of a specific time interval which is provided for said computing means and during which said computing means does not accept said interrupt signal.

4. A method as claimed in either of claims 1 or 2, wherein said time-counting means comprises a single time counter.

5. A method as claimed in either of claims 1 or 2, wherein said electrical device or devices are fuel injection valves.

* * * * *

UNITED STATES PATENT AND TRADEMARK OFFICE

CERTIFICATE OF CORRECTION

PATENT NO. : 4,964,050

DATED : October 16, 1990

INVENTOR(S) : Yakuwa, et. al.

It is certified that error appears in the above-identified patent and that said Letters Patent is hereby corrected as shown below:

On the Title page, item [30], under Priority Applications, change "December 12, 1991" to -- May 12, 1991 -- (in all three cases).

Signed and Sealed this

Twenty-eighth Day of September, 1993

*Attest:*

*Attesting Officer*

BRUCE LEHMAN

*Commissioner of Patents and Trademarks*